US005632424A

United States Patent [19]

Maier et al.

[11] Patent Number: 5,632,424

[45] Date of Patent: May 27, 1997

[54] SOCK DONNING ASSIST DEVICE

[76] Inventors: Manfred Maier; H. Millicent MacCannell, both of c/o Samtex Inc., 205 E. Erie St., Blauvelt, N.Y. 10913

[21] Appl. No.: 599,807

[22] Filed: Feb. 12, 1996

[51] Int. Cl.[6] ..... A47G 25/90

[52] U.S. Cl. ..... 223/112; 223/111

[58] Field of Search ..... 223/111, 112, 223/113, 118, 120

[56] References Cited

U.S. PATENT DOCUMENTS

| | | | |
|---|---|---|---|
| D. 337,881 | 8/1993 | Peeler | D2/641 |
| 4,066,194 | 1/1978 | Leland | 223/111 |
| 4,260,083 | 4/1981 | Aslin | 223/111 |
| 4,284,216 | 8/1981 | Leland | 223/111 |
| 4,516,704 | 5/1985 | Hagman | 223/111 |
| 4,638,932 | 1/1987 | Keller | 223/111 |
| 4,789,087 | 12/1988 | Doorenbos | 223/111 |
| 4,896,803 | 1/1990 | Wilkens | 223/112 |
| 4,942,988 | 7/1990 | Doorenbos | 223/111 |
| 5,249,720 | 10/1993 | White | 223/112 |
| 5,303,856 | 4/1994 | Weatherholt, Sr. | 223/111 |
| 5,322,199 | 6/1994 | White | 223/111 |

*Primary Examiner*—Bibhu Mohanty
*Attorney, Agent, or Firm*—Richard L. Miller

[57] ABSTRACT

A sock donning assist device that allows a caretaker to put a sock on a disabled person who can not put the sock on themselves. The sock donning assist device includes a hollow rigid substantially L-shaped frame. The hollow rigid substantially L-shaped frame consists of a plurality of different sized and shaped slender members. The plurality of different sized and shaped slender members form a substantially vertically-oriented portion for retaining a sock during donning wherein the sock has an upper portion and a lower portion, and a horizontally-oriented portion extending forwardly from the substantially vertically-oriented portion of the hollow rigid substantially L-shaped frame for gripping by a user during donning the sock. Prior to donning the sock the substantially vertically-oriented portion of the hollow rigid substantially L-shaped frame receives the lower portion of the sock and the substantially vertically-oriented portion of the hollow rigid substantially L-shaped frame is received by the upper portion of the sock. During donning the substantially vertically-oriented portion of the hollow rigid substantially L-shaped frame is progressively removed from the upper portion of the sock.

16 Claims, 2 Drawing Sheets

SOCK DONNING ASSIST DEVICE

BACKGROUND OF THE INVENTION

The present invention relates to a sock donning assist device. More particularly, the present invention relates to a sock donning assist device that is rigid and includes a three dimensional frame in a substantially L-shaped configuration.

Many individuals with circulatory disorders are required to wear tight-fitting hosiery or stockings which are designed to support the legs and reduce the pooling of fluids in the legs and feet of the individual. Because of the strongly elastic nature of these stockings, many persons find it difficult to exert the force needed to apply the stockings over their feet and legs. In addition there are numerous individual who lack the flexibility to bend their legs or body to the degree needed to apply support stockings or even socks.

Various designs of devices for putting on stockings are known and devised to help disabled persons suffering from various handicaps in their ability to move.

There exist staff-shaped devices which are provided with hoop or sleeve-like members of varying shape and which usually are made of metal or other stiff material. These type of devices have a low friction coefficient and therefore a stocking easily slips off before it has reached the correct position.

There also exist devices which are made of soft material. These type of devices are not so common and the pull-on devices of this kind which now exist require great user mobility.

Numerous innovations for sock donning assist devices have been provided in the prior art that will be described. However, even though these innovations may be suitable for the specific individual purposes to which they address, they differ from the present invention in that they do not teach a sock donning assist device that is rigid and includes a three dimensional frame in a substantially L-shaped configuration.

FOR EXAMPLE, U.S. Pat. No. Des. 337,881 to Peeler teaches a stocking holder that includes a frame consisting of a plurality of elongated slender tubular members.

ANOTHER EXAMPLE, U.S. Pat. No. 4,066,194 to Leland teaches a sock donning device that includes a handle member from which laterally and transversely depend a pair of sock expanding and gripping members, and a combination frame positioner and sock release device.

STILL ANOTHER EXAMPLE, U.S. Pat. No. 4,260,083 to Aslin teaches a pull-on device for stockings that includes a stocking-foot resembling piece. The sole of the piece is stiff in the longitudinal direction and resilient at a middle portion. The middle portion is connected at the heel part with a rearward protruding plate member.

YET ANOTHER EXAMPLE, U.S. Pat. No. 4,284,216 to Leland teaches a sock donning assist device that includes a sock donning device that includes a handle member from which laterally and transversely depend a pair of sock expanding and holding members, and a control bar that extends between the wire-like handle members so as to adjust the space therebetween.

STILL YET ANOTHER EXAMPLE, U.S. Pat. No. 4,516, 704 to Hagman teaches a hosiery donning aid that includes a rigid hoop and a handle. The handle is telescopic and pivotally secured to the inside of the hoop.

YET STILL ANOTHER EXAMPLE, U.S. Pat. No. 4,638, 932 to Keller teaches a donning aid that includes a tong-like member having a pair of elongated arms extending from a handle end to a gripping end. The arms are integrally joined at the handle end in a U-bend and extend substantially parallel in close side-by-side relationship to the gripping end. Resilient protective pads are provided at the gripping end of each arm.

STILL YET ANOTHER EXAMPLE, U.S. Pat. No. 4,789, 087 to Doorenbos teaches a device for assisting in putting on elastic hosiery that includes an expandable tip consisting of a division in the portion over which the stocking is placed, means for biasing the two split parts to a normally closed position, and a latch to hold the device in an open position.

YET STILL ANOTHER EXAMPLE, U.S. Pat. No. 4,896, 803 to Wilkens teaches an aid for putting on stockings that includes a frame-like construction with at least four substantially equidistantly spaced substantially parallel-extending support rods having first ends and second ends. The first ends are interconnected by means of a first clip and the second ends are interconnected by means of a second clip.

STILL YET ANOTHER EXAMPLE, U.S. Pat. No. 4,942, 988 to Doorenbos teaches a device to aid in putting on elastic hose that includes two looped ends to be inserted into the stocking. The loops are hinged together and movable between a closed position and a spread position. The hinge includes a slide.

YET STILL ANOTHER EXAMPLE, U.S. Pat. No. 5,249, 720 to White teaches a tool for applying support stockings that includes a tongue positioned between side rails which are connected to handles. The tongue includes an extension which is engaged by the handles to cause centering of the tongue between the side rails.

STILL YET ANOTHER EXAMPLE, U.S. Pat. No. 5,303, 856 to Weatherholt, Sr. teaches a sock donning apparatus that includes a support post arranged to slidably mount a guide tube having a platform secured thereon. The platform includes a support arm with a generally U-shaped support plated that is oriented at an obtuse angle relative to the platform.

FINALLY, YET STILL ANOTHER EXAMPLE, U.S. Pat. No. 5,322,199 to White teaches an apparatus for assisting a person in putting on a stocking that includes an arcuate hollow form is releasibly attached to the upper edge of a stocking by clamp elements located at spaced points on the hollow form. Elongated straps extend from the clamping points.

It is apparent that numerous innovations for sock donning assist devices have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a sock donning assist device that avoids the disadvantages of the prior art.

ANOTHER OBJECT of the present invention is to provide a sock donning assist device that is simple and inexpensive to manufacture.

STILL ANOTHER OBJECT of the present invention is to provide a sock donning assist device that is simple to use.

YET ANOTHER OBJECT of the present invention is to provide a sock donning assist device that enables a caretaker to put on regular socks or support stockings on a person who has difficulty doing so by themselves.

STILL YET ANOTHER OBJECT of the present invention is to provide a sock donning assist device that eliminates difficulty, annoyance, possible pain, and aggravation, to the caretakers and to the patient, when putting on footwear.

YET STILL ANOTHER OBJECT of the present invention is to provide a sock donning assist device that enables the foot of the patient to be smoothly inserted into the stocking, which is already opened and ready for application, without having to drag the stocking on.

STILL YET ANOTHER OBJECT of the present invention is to provide a sock donning assist device that allows a patient to put a stocking thereon and thereby giving the patient a sense of participation in their own care, a feeling of independence, and an elevation of their self esteem.

BRIEFLY STATED, YET STILL ANOTHER OBJECT of the present invention is to provide a sock donning assist device that includes a hollow rigid substantially L-shaped frame.

STILL YET ANOTHER OBJECT of the present invention is to provide a sock donning assist device wherein the hollow rigid substantially L-shaped frame consists of a plurality of different sized and shaped slender members.

YET STILL ANOTHER OBJECT of the present invention is to provide a sock donning assist device wherein the plurality of different sized and shaped slender members form a substantially vertically-oriented portion for retaining a sock during donning wherein the sock has an upper portion and a lower portion, and a horizontally-oriented portion extending forwardly from the substantially vertically-oriented portion of the hollow rigid substantially L-shaped frame for gripping by a user during donning the sock.

STILL YET ANOTHER OBJECT of the present invention is to provide a sock donning assist device wherein prior to donning the sock the substantially vertically-oriented portion of the hollow rigid substantially L-shaped frame receives the lower portion of the sock and the substantially vertically-oriented portion of the hollow rigid substantially L-shaped frame is received by the upper portion of the sock.

YET STILL ANOTHER OBJECT of the present invention is to provide a sock donning assist device wherein during donning the substantially vertically-oriented portion of the hollow rigid substantially L-shaped frame is progressively removed from the upper portion of the sock.

STILL YET ANOTHER OBJECT of the present invention is to provide a sock donning assist device wherein the hollow rigid substantially L-shaped frame is selected from the group consisting of metal and plastic.

YET STILL ANOTHER OBJECT of the present invention is to provide a sock donning assist device wherein the horizontally-oriented portion of the hollow rigid substantially L-shaped frame includes a pair of lower side, straight, substantially parallel-disposed, spaced-apart, horizontally-oriented, elongated, and slender members.

STILL YET ANOTHER OBJECT of the present invention is to provide a sock donning assist device wherein each of the pair of lower side, straight, substantially parallel-disposed, spaced-apart, horizontally-oriented, elongated, and slender members of the horizontally-oriented portion of the hollow rigid substantially L-shaped frame has a front end, a back end, and a length.

YET STILL ANOTHER OBJECT of the present invention is to provide a sock donning assist device wherein the horizontally-oriented portion of the hollow rigid substantially L-shaped frame further includes a pair of lower front, straight, substantially parallel-disposed, spaced-apart, substantially vertically-oriented, elongated, and slender members.

STILL YET ANOTHER OBJECT of the present invention is to provide a sock donning assist device wherein each of the pair of lower front, straight, substantially parallel-disposed, spaced-apart, substantially vertically-oriented, elongated, and slender members of the horizontally-oriented portion of the hollow rigid substantially L-shaped frame is a gripping handle and has a lower end, an upper end, an intermediate point, and a length.

YET STILL ANOTHER OBJECT of the present invention is to provide a sock donning assist device wherein each of the pair of lower front, straight, substantially parallel-disposed, spaced-apart, substantially vertically-oriented, elongated, and slender members of the horizontally-oriented portion of the hollow rigid substantially L-shaped frame extend at the lower end of each of the pair of lower front, straight, substantially parallel-disposed, spaced-apart, substantially vertically-oriented, elongated, and slender members of the horizontally-oriented portion of the hollow rigid substantially L-shaped frame smoothly upwardly at an obtuse angle and slightly forwardly at an obtuse angle from the front end of each of the pair of lower side, straight, substantially parallel-disposed, spaced-apart, horizontally-oriented, elongated, and slender members of the horizontally-oriented portion of the hollow rigid substantially L-shaped frame and together therewith forms a smooth convex-shaped bend.

STILL YET ANOTHER OBJECT of the present invention is to provide a sock donning assist device wherein the pair of lower front, straight, substantially parallel-disposed, spaced-apart, substantially vertically-oriented, elongated, and slender members of the horizontally-oriented portion of the hollow rigid substantially L-shaped frame are spaced-apart a distance substantially equal to the distance between the pair of lower side, straight, substantially parallel-disposed, spaced-apart, horizontally-oriented, elongated, and slender members of the horizontally-oriented portion of the hollow rigid substantially L-shaped frame.

YET STILL ANOTHER OBJECT of the present invention is to provide a sock donning assist device wherein the horizontally-oriented portion of the hollow rigid substantially L-shaped frame further includes a pair of upper intermediate side, straight, substantially parallel-disposed, spaced-apart, horizontally-oriented, elongated, and slender members.

STILL YET ANOTHER OBJECT of the present invention is to provide a sock donning assist device wherein each of the pair of upper intermediate side, straight, substantially parallel-disposed, spaced-apart, horizontally-oriented, elongated, and slender members of the horizontally-oriented portion of the hollow rigid substantially L-shaped frame has a front end, a back end, and a length.

YET STILL ANOTHER OBJECT of the present invention is to provide a sock donning assist device wherein each of the pair of upper intermediate side, straight, substantially parallel-disposed, spaced-apart, horizontally-oriented, elongated, and slender members of the horizontally-oriented portion of the hollow rigid substantially L-shaped frame extend at the front end of each of the pair of upper intermediate side, straight, substantially parallel-disposed, spaced-apart, horizontally-oriented, elongated, and slender members of the horizontally-oriented portion of the hollow rigid substantially L-shaped frame smoothly rearwardly at an acute angle from the upper end of each of the pair of lower front, straight, substantially parallel-disposed, spaced-apart, substantially vertically-oriented, elongated, and slender members of the horizontally-oriented portion of the hollow rigid substantially L-shaped frame and together therewith forms a smooth convex-shaped bend.

STILL YET ANOTHER OBJECT of the present invention is to provide a sock donning assist device wherein the pair of upper intermediate side, straight, substantially parallel-disposed, spaced-apart, horizontally-oriented, elongated, and slender members of the horizontally-oriented portion of the hollow rigid substantially L-shaped frame are spaced-apart a distance substantially equal to the distance between the pair of lower side, straight, substantially parallel-disposed, spaced-apart, horizontally-oriented, elongated, and slender members of the horizontally-oriented portion of the hollow rigid substantially L-shaped frame.

YET STILL ANOTHER OBJECT of the present invention is to provide a sock donning assist device wherein the pair of upper intermediate side, straight, substantially parallel-disposed, spaced-apart, horizontally-oriented, elongated, and slender members of the horizontally-oriented portion of the hollow rigid substantially L-shaped frame are substantially parallel to, and displaced a distance above, the pair of lower side, straight, substantially parallel-disposed, spaced-apart, horizontally-oriented, elongated, and slender members of the horizontally-oriented portion of the hollow rigid substantially L-shaped frame.

STILL YET ANOTHER OBJECT of the present invention is to provide a sock donning assist device wherein the length of each of the pair of upper intermediate side, straight, substantially parallel-disposed, spaced-apart, horizontally-oriented, elongated, and slender members of the horizontally-oriented portion of the hollow rigid substantially L-shaped frame is less than the length of each of the pair of lower side, straight, substantially parallel-disposed, spaced-apart, horizontally-oriented, elongated, and slender members of the horizontally-oriented portion of the hollow rigid substantially L-shaped frame.

YET STILL ANOTHER OBJECT of the present invention is to provide a sock donning assist device wherein the horizontally-oriented portion of the hollow rigid substantially L-shaped frame further includes a pair of upper intermediate side, straight, substantially parallel-disposed, spaced-apart, horizontally-oriented, elongated, and slender members.

STILL YET ANOTHER OBJECT of the present invention is to provide a sock donning assist device wherein each of the pair of upper intermediate side, straight, substantially parallel-disposed, spaced-apart, horizontally-oriented, elongated, and slender members of the horizontally-oriented portion of the hollow rigid substantially L-shaped frame has a front end, a back end, and a length.

YET STILL ANOTHER OBJECT of the present invention is to provide a sock donning assist device wherein each of the pair of upper intermediate side, straight, substantially parallel-disposed, spaced-apart, horizontally-oriented, elongated, and slender members of the horizontally-oriented portion of the hollow rigid substantially L-shaped frame extend at the front end of each of the pair of upper intermediate side, straight, substantially parallel-disposed, spaced-apart, horizontally-oriented, elongated, and slender members of the horizontally-oriented portion of the hollow rigid substantially L-shaped frame smoothly rearwardly at an acute angle from the upper end of each of the pair of lower front, straight, substantially parallel-disposed, spaced-apart, substantially vertically-oriented, elongated, and slender members of the horizontally-oriented portion of the hollow rigid substantially L-shaped frame and together therewith forms a smooth concave-shaped bend.

STILL YET ANOTHER OBJECT of the present invention is to provide a sock donning assist device wherein the pair of upper intermediate side, straight, substantially parallel-disposed, spaced-apart, horizontally-oriented, elongated, and slender members of the horizontally-oriented portion of the hollow rigid substantially L-shaped frame are spaced-apart a distance substantially equal to the distance between the pair of lower side, straight, substantially parallel-disposed, spaced-apart, horizontally-oriented, elongated, and slender members of the horizontally-oriented portion of the hollow rigid substantially L-shaped frame.

YET STILL ANOTHER OBJECT of the present invention is to provide a sock donning assist device wherein the pair of upper intermediate side, straight, substantially parallel-disposed, spaced-apart, horizontally-oriented, elongated, and slender members of the horizontally-oriented portion of the hollow rigid substantially L-shaped frame are substantially parallel to, and displaced a distance above, the pair of lower side, straight, substantially parallel-disposed, spaced-apart, horizontally-oriented, elongated, and slender members of the horizontally-oriented portion of the hollow rigid substantially L-shaped frame.

STILL YET ANOTHER OBJECT of the present invention is to provide a sock donning assist device wherein the length of each of the pair of upper intermediate side, straight, substantially parallel-disposed, spaced-apart, horizontally-oriented, elongated, and slender members of the horizontally-oriented portion of the hollow rigid substantially L-shaped frame is less than the length of each of the pair of lower side, straight, substantially parallel-disposed, spaced-apart, horizontally-oriented, elongated, and slender members of the horizontally-oriented portion of the hollow rigid substantially L-shaped frame.

YET STILL ANOTHER OBJECT of the present invention is to provide a sock donning assist device wherein the substantially vertically-oriented portion of the hollow rigid substantially L-shaped frame includes a pair of lower back, straight, slightly inwardly tapering, substantially vertically-oriented, elongated, and slender members.

STILL YET ANOTHER OBJECT of the present invention is to provide a sock donning assist device wherein each of the pair of lower back, straight, slightly inwardly tapering, substantially vertically-oriented, elongated, and slender members of the substantially vertically-oriented portion of the hollow rigid substantially L-shaped frame has a lower end, an upper end, and a length.

YET STILL ANOTHER OBJECT of the present invention is to provide a sock donning assist device wherein each of the pair of lower back, straight, slightly inwardly tapering, substantially vertically-oriented, elongated, and slender members of the substantially vertically-oriented portion of the hollow rigid substantially L-shaped frame extend at the lower end of each of the pair of lower back, straight, slightly inwardly tapering, substantially vertically-oriented, elongated, and slender members of the substantially vertically-oriented portion of the hollow rigid substantially L-shaped frame smoothly upwardly at an obtuse angle and slightly rearwardly at an obtuse angle from the back end of each of the pair of lower side, straight, substantially parallel-disposed, spaced-apart, horizontally-oriented, elongated, and slender members of the horizontally-oriented portion of the hollow rigid substantially L-shaped frame and together therewith forms a smooth convex-shaped bend.

STILL YET ANOTHER OBJECT of the present invention is to provide a sock donning assist device wherein the pair of lower back, straight, slightly inwardly tapering, substantially vertically-oriented, elongated, and slender members of the substantially vertically-oriented portion of the hollow rigid substantially L-shaped frame are displaced a distance behind the pair of lower front, straight, substantially parallel-disposed, spaced-apart, substantially vertically-oriented, elongated, and slender members of the horizontally-oriented portion of the hollow rigid substantially L-shaped frame and are displaced a distance behind the pair of upper intermediate side, straight, substantially parallel-disposed, spaced-apart, horizontally-oriented, elongated, and slender members of the horizontally-oriented portion of the hollow rigid substantially L-shaped frame.

YET STILL ANOTHER OBJECT of the present invention is to provide a sock donning assist device wherein the length of each of the pair of lower back, straight, slightly inwardly tapering, substantially vertically-oriented, elongated, and slender members of the substantially vertically-oriented portion of the hollow rigid substantially L-shaped frame is greater than the length of each of the pair of lower front, straight, substantially parallel-disposed, spaced-apart, substantially vertically-oriented, elongated and slender members of the horizontally-oriented portion of the hollow rigid substantially L-shaped frame.

STILL YET ANOTHER OBJECT of the present invention is to provide a sock donning assist device wherein the substantially vertically-oriented portion of the hollow rigid substantially L-shaped frame further includes a pair of intermediate back, straight, substantially parallel-disposed, spaced-apart, vertically-oriented, short, and slender members.

YET STILL ANOTHER OBJECT of the present invention is to provide a sock donning assist device wherein each of the pair of intermediate back, straight, substantially parallel-disposed, spaced-apart, vertically-oriented, short, and slender members of the substantially vertically-oriented portion of the hollow rigid substantially L-shaped frame has a lower end, an upper end, and a length.

STILL YET ANOTHER OBJECT of the present invention is to provide a sock donning assist device wherein each of the pair of intermediate back, straight, substantially parallel-disposed, spaced-apart, vertically-oriented, short, and slender members of the substantially vertically-oriented portion of the hollow rigid substantially L-shaped frame extend at the lower end of each of the pair of intermediate back, straight, substantially parallel-disposed, spaced-apart, vertically-oriented, short, and slender members of the substantially vertically-oriented portion of the hollow rigid substantially L-shaped frame smoothly upwardly at an obtuse angle from the upper end of each of the pair of lower back, straight, slightly inwardly tapering, substantially vertically-oriented, elongated, and slender members of the substantially vertically-oriented portion of the hollow rigid substantially L-shaped frame and together therewith forms a smooth convex-shaped bend.

YET STILL ANOTHER OBJECT of the present invention is to provide a sock donning assist device wherein the pair of intermediate back, straight, substantially parallel-disposed, spaced-apart, vertically-oriented, short, and slender members of the vertically-oriented portion of the hollow rigid substantially L-shaped frame are displaced a distance behind the pair of lower front, straight, substantially parallel-disposed, spaced-apart, substantially vertically-oriented, elongated, and slender members of the horizontally-oriented portion of the hollow rigid substantially L-shaped frame and are displaced a distance behind the pair of upper intermediate side, straight, substantially parallel-disposed, spaced-apart, horizontally-oriented, elongated, and slender members of the horizontally-oriented portion of the hollow rigid substantially L-shaped frame.

STILL YET ANOTHER OBJECT of the present invention is to provide a sock donning assist device wherein the substantially vertically-oriented portion of the hollow rigid substantially L-shaped frame further includes an upper back, semi-circular, vertically oriented, elongated, and slender connecting member.

YET STILL ANOTHER OBJECT of the present invention is to provide a sock donning assist device wherein the upper back, semi-circular, vertically oriented, elongated, and slender connecting member of the substantially vertically-oriented portion of the hollow rigid substantially L-shaped frame has a pair of ends, a midway point, and a span.

STILL YET ANOTHER OBJECT of the present invention is to provide a sock donning assist device wherein the upper back, semi-circular, vertically oriented, elongated, and slender connecting member of the vertically-oriented portion of the hollow rigid substantially L-shaped frame extends at each of the pair of ends of the upper back, semi-circular, vertically oriented, elongated and slender member of the substantially vertically-oriented portion of the hollow rigid substantially L-shaped frame smoothly upwardly from the upper end of each of the pair of intermediate back, straight, substantially parallel-disposed, spaced-apart, vertically-oriented, short, and slender members of the vertically-oriented portion of the hollow rigid substantially L-shaped frame.

YET STILL ANOTHER OBJECT of the present invention is to provide a sock donning assist device wherein the upper back, semi-circular, vertically oriented, elongated, and slender connecting member of the substantially vertically-oriented portion of the hollow rigid substantially L-shaped frame is displaced a distance behind the pair of lower front, straight, substantially parallel-disposed, spaced-apart, substantially vertically-oriented, elongated, and slender members of the horizontally-oriented portion of the hollow rigid substantially L-shaped frame and is displaced a distance behind the pair of upper intermediate side, straight, substantially parallel-disposed, spaced-apart, horizontally-oriented, elongated, and slender members of the horizontally-oriented portion of the hollow rigid substantially L-shaped frame.

STILL YET ANOTHER OBJECT of the present invention is to provide a sock donning assist device wherein the horizontally-oriented portion of the hollow rigid substantially L-shaped frame further includes a pair of lower intermediate side, straight, substantially parallel-disposed, skew-oriented, elongated, and slender members.

YET STILL ANOTHER OBJECT of the present invention is to provide a sock donning assist device wherein each of the pair of lower intermediate side, straight, substantially parallel-disposed, skew-oriented, elongated, and slender members of the horizontally-oriented portion of the hollow rigid substantially L-shaped frame has a front end, a back end, and a length.

STILL YET ANOTHER OBJECT of the present invention is to provide a sock donning assist device wherein each of the pair of lower intermediate side, straight, substantially parallel-disposed, skew-oriented, elongated, and slender members of the horizontally-oriented portion of the hollow rigid substantially L-shaped frame extend at the front end of each of the pair of lower intermediate side, straight, substantially parallel-disposed, skew-oriented, elongated, and slender members of the horizontally-oriented portion of the hollow rigid substantially L-shaped frame abruptly rearwardly and slightly upwardly at an obtuse angle from the intermediate point of each of the pair of lower front, straight, substantially parallel-disposed, spaced-apart, substantially vertically-oriented, elongated, and slender members of the horizontally-oriented portion of the hollow rigid substantially L-shaped frame.

YET STILL ANOTHER OBJECT of the present invention is to provide a sock donning assist device wherein each of the pair of lower intermediate side, straight, substantially parallel-disposed, skew-oriented, elongated, and slender members of the horizontally-oriented portion of the hollow rigid substantially L-shaped frame are displaced a distance above, and in the same vertical plane as, each of the pair of lower side, straight, substantially parallel-disposed, spaced-apart, horizontally-oriented, elongated, and slender members of the horizontally-oriented portion of the hollow rigid substantially L-shaped frame and are displaced a distance below, and in the same vertical plane as, each of the pair of upper intermediate side, straight, substantially parallel-disposed, spaced-apart, horizontally-oriented, elongated, and slender members of the horizontally-oriented portion of the hollow rigid substantially L-shaped frame.

STILL YET ANOTHER OBJECT of the present invention is to provide a sock donning assist device wherein the length of each of the pair of lower intermediate side, straight, substantially parallel-disposed, skew-oriented, elongated and slender members of the horizontally-oriented portion of the hollow rigid substantially L-shaped frame is less than the length of each of the pair of lower side, straight, substantially parallel-disposed, spaced-apart, horizontally-oriented, elongated, and slender members of the horizontally-oriented portion of the hollow rigid substantially L-shaped frame and greater than the length of the pair of upper intermediate side, straight, substantially parallel-disposed, spaced-apart, horizontally-oriented, elongated, and slender members of the horizontally-oriented portion of the hollow rigid substantially L-shaped frame.

YET STILL ANOTHER OBJECT of the present invention is to provide a sock donning assist device wherein the front end of each of the pair of lower intermediate side, straight, substantially parallel-disposed, skew-oriented, elongated, and slender members of the horizontally-oriented portion of the hollow rigid substantially L-shaped frame is affixed to the intermediate point of each of the pair of lower front, straight, substantially parallel-disposed, spaced-apart, substantially vertically-oriented, elongated, and slender members of the horizontally-oriented portion of the hollow rigid substantially L-shaped frame by suitable fastening means that is compatible with the material of the sock donning assist device.

STILL YET ANOTHER OBJECT of the present invention is to provide a sock donning assist device wherein the substantially vertically-oriented portion of the hollow rigid substantially L-shaped frame further includes a pair of upper front, straight, substantially parallel-disposed, spaced-apart, substantially vertically-oriented, elongated, and slender members.

YET STILL ANOTHER OBJECT of the present invention is to provide a sock donning assist device wherein each of the pair of upper front, straight, substantially parallel-disposed, spaced-apart, substantially vertically-oriented, elongated, slender members of the substantially vertically-oriented portion of the hollow rigid substantially L-shaped frame has a lower end, an upper end, and a length.

STILL YET ANOTHER OBJECT of the present invention is to provide a sock donning assist device wherein each of the pair of upper front, straight, substantially parallel-disposed, spaced-apart, substantially vertically-oriented, elongated, and slender members of the vertically oriented portion of the hollow rigid substantially L-shaped frame extend at the lower end of each of the pair of upper front, straight, substantially parallel-disposed, spaced-apart, substantially vertically-oriented, elongated, and slender members of the substantially vertically-oriented portion of the hollow rigid substantially L-shaped frame smoothly upwardly and slightly rearwardly at an obtuse angle from the back end of each of the pair of lower intermediate side, straight, substantially parallel-disposed, skew-oriented, elongated, and slender members of the horizontally-oriented portion of the hollow rigid substantially L-shaped frame and together therewith forms a smooth concave-shaped.

YET STILL ANOTHER OBJECT of the present invention is to provide a sock donning assist device wherein the pair of upper front, straight, substantially parallel-disposed, spaced-apart, substantially vertically-oriented, elongated, and slender members of the vertically-oriented portion of the hollow rigid substantially L-shaped frame are substantially parallel to, and displaced a distance forward of, the pair of lower back, straight, slightly inwardly tapering, substantially vertically-oriented, elongated, and slender members of the substantially vertically-oriented portion of the hollow rigid substantially L-shaped frame and are displaced a distance rearward of the pair of lower front, straight, substantially parallel-disposed, spaced-apart, substantially vertically-oriented, elongated, and slender members of the horizontally-oriented portion of the hollow rigid substantially L-shaped frame.

STILL YET ANOTHER OBJECT of the present invention is to provide a sock donning assist device wherein the length of each of the pair of upper front, straight, substantially parallel-disposed, spaced-apart, substantially vertically-oriented, elongated, and slender members of the substantially vertically-oriented portion of the hollow rigid substantially L-shaped frame is less than the length of each of the pair of lower back, straight, slightly inwardly tapering, substantially vertically-oriented, elongated, and slender members of the vertically-oriented portion of the hollow rigid substantially L-shaped frame.

YET STILL ANOTHER OBJECT of the present invention is to provide a sock donning assist device wherein the back end of each of the pair of upper intermediate side, straight, substantially parallel-disposed, spaced-apart, horizontally-oriented, elongated, and slender members of the horizontally-oriented portion of the hollow rigid substantially L-shaped frame abruptly meets at an obtuse angle, the lower end of each of the pair of upper front, straight, substantially parallel-disposed, spaced-apart, substantially vertically-oriented, elongated, and slender members of the substantially vertically-oriented portion of the hollow rigid substantially L-shaped frame and are affixed thereto by the suitable fastening means.

STILL YET ANOTHER OBJECT of the present invention is to provide a sock donning assist device wherein the substantially vertically-oriented portion of the hollow rigid substantially L-shaped frame further includes a U-shaped top, horizontally-oriented, forwardly opening, elongated, and slender member.

YET STILL ANOTHER OBJECT of the present invention is to provide a sock donning assist device wherein the U-shaped top, horizontally-oriented, forwardly opening, elongated, and slender member of the vertically-oriented portion of the hollow rigid substantially L-shaped frame has a ends, a midway point, and a span.

STILL YET ANOTHER OBJECT of the present invention is to provide a sock donning assist device wherein the U-shaped top, horizontally oriented, forwardly opening, elongated, and slender member of the substantially vertically-oriented portion of the hollow rigid substantially L-shaped frame extends at the pair of ends of the U-shaped top, horizontally oriented, forwardly opening, elongated, and slender member of the substantially vertically-oriented portion of the hollow rigid substantially L-shaped frame smoothly rearwardly at an obtuse angle from the upper end of each of the pair of upper front, straight, substantially parallel-disposed, spaced-apart, substantially vertically-oriented, elongated, and slender members of the vertically-oriented portion of the hollow rigid substantially L-shaped frame and together therewith forms a smooth convex-shaped bend.

YET STILL ANOTHER OBJECT of the present invention is to provide a sock donning assist device wherein the U-shaped top, horizontally oriented, forwardly opening, elongated, and slender member of the substantially vertically-oriented portion of the hollow rigid substantially L-shaped frame is substantially parallel to, and displaced a distance above, the pair of lower side, straight, substantially parallel-disposed, spaced-apart, horizontally-oriented, elongated, and slender members of the horizontally-oriented portion of the hollow rigid substantially L-shaped frame and is displaced a distance above the pair of upper intermediate side, straight, substantially parallel-disposed, spaced-apart, horizontally-oriented, elongated, and slender members of the horizontally-oriented portion of the hollow rigid substantially L-shaped frame.

STILL YET ANOTHER OBJECT of the present invention is to provide a sock donning assist device wherein the span of the U-shaped top, horizontally oriented, elongated, and slender member of the substantially vertically-oriented portion of the hollow rigid substantially L-shaped frame is less than the length of the pair of lower side, straight, substantially parallel-disposed, spaced-apart, horizontally-oriented, elongated, and slender members of the horizontally-oriented of the hollow rigid substantially L-shaped frame.

YET STILL ANOTHER OBJECT of the present invention is to provide a sock donning assist device wherein the midway point of the U-shaped top, horizontally oriented, elongated, and slender member of the substantially vertically-oriented portion of the hollow rigid substantially L-shaped frame is affixed to the midway point of the upper back semi-circular, vertically oriented, elongated, and slender member of the substantially vertically-oriented portion of the hollow rigid substantially L-shaped frame, by the suitable fastening means.

STILL YET ANOTHER OBJECT of the present invention is to provide a sock donning assist device wherein the substantially vertically-oriented portion of the hollow rigid substantially L-shaped frame further includes a lower back, straight, horizontally-oriented, elongated, and slender connecting member.

YET STILL ANOTHER OBJECT of the present invention is to provide a sock donning assist device wherein the lower back, straight, horizontally-oriented, elongated, and slender connecting member of the substantially vertically-oriented portion of the hollow rigid substantially L-shaped frame has a pair of ends, and a length.

STILL YET ANOTHER OBJECT of the present invention is to provide a sock donning assist device wherein the lower back, straight, horizontally-oriented, elongated, and slender connecting member of the substantially vertically-oriented portion of the hollow rigid substantially L-shaped frame extends at the pair of ends of the lower back, straight, horizontally-oriented, elongated and slender member of the substantially vertically-oriented portion of the hollow rigid substantially L-shaped frame smoothly at a right angle from an area in proximity to the lower end of each of the pair of lower back, straight, slightly inwardly tapering, substantially vertically-oriented, elongated, and slender members of the vertically-oriented portion of the hollow rigid substantially L-shaped frame.

YET STILL ANOTHER OBJECT of the present invention is to provide a sock donning assist device wherein the lower back, straight, horizontally-oriented, elongated, and slender connecting member of the substantially vertically-oriented portion of the hollow rigid substantially L-shaped frame is displaced a distance behind the pair of lower front, straight, substantially parallel-disposed, spaced-apart, substantially vertically-oriented, elongated, and slender members of the horizontally-oriented portion of the hollow rigid substantially L-shaped frame.

FINALLY, STILL YET ANOTHER OBJECT of the present invention is to provide a method of using a sock donning assist device that includes the steps of placing a lower portion of a sock through a U-shaped top, horizontally oriented, forwardly opening, elongated, and slender member of a substantially vertically-oriented portion of a hollow rigid substantially L-shaped frame of the sock donning assist device with the lower portion of the sock positioned in the interior space of the substantially vertically-oriented portion of the hollow rigid substantially L-shaped frame, stretching an upper portion of the sock over the U-shaped top, horizontally oriented, forwardly opening, elongated, and slender member of the substantially vertically-oriented portion of the hollow rigid substantially L-shaped frame, pulling down the upper portion of the sock over the exterior of the substantially vertically-oriented portion of the hollow rigid substantially L-shaped frame and releasing so as to be compressingly secured thereto and ready for application, gripping a pair of lower front, straight, substantially parallel-disposed, spaced-apart, substantially vertically-oriented, elongated, and slender members of a horizontally-oriented portion of the hollow rigid substantially L-shaped frame by the hands of a user with the forefingers being separated from the remaining fingers by a pair of lower intermediate side, straight, substantially parallel-disposed, skew-oriented, elongated and slender members of the horizontally-oriented portion of the hollow rigid substantially L-shaped frame, so that gripping ability is increased and unwanted rotation of the sock donning assist device is reduced during use, inserting a toe portion a foot of a leg into the lower portion of the sock, pushing gently upwards the sock donning assist device and the sock upwards on the leg with the upper portion of the sock pulling up and off the exterior of the substantially vertically-oriented portion of the hollow rigid substantially L-shaped frame and becoming compressingly secured to the leg, and removing the sock donning assist device with the leg leaving the U-shaped top, horizontally oriented, forwardly opening, elongated, and slender member of the substantially vertically-oriented portion of the hollow rigid substantially L-shaped frame.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figures 1, 2, 5:
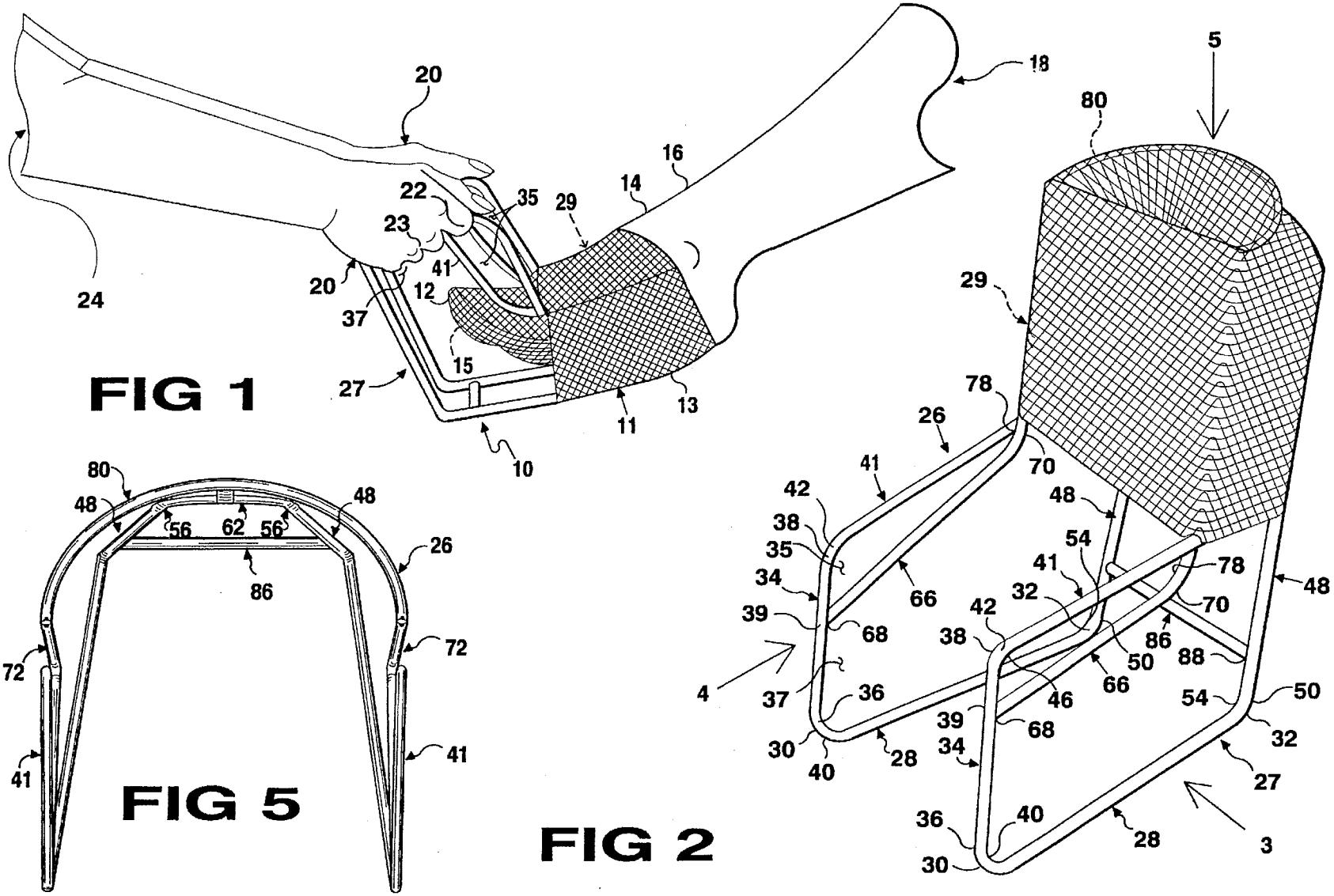
FIG. 1 is a diagrammatic perspective view illustrating the present invention being utilized to don sock.
FIG. 2 is a diagrammatic perspective view illustrating the present invention with a sock installed thereon.
FIG. 5 is a diagrammatic top plan view of the present invention, with parts broken away, taken in the direction of arrow 5 in FIG. 2, with the stocking removed for clarity.
Figure 4:
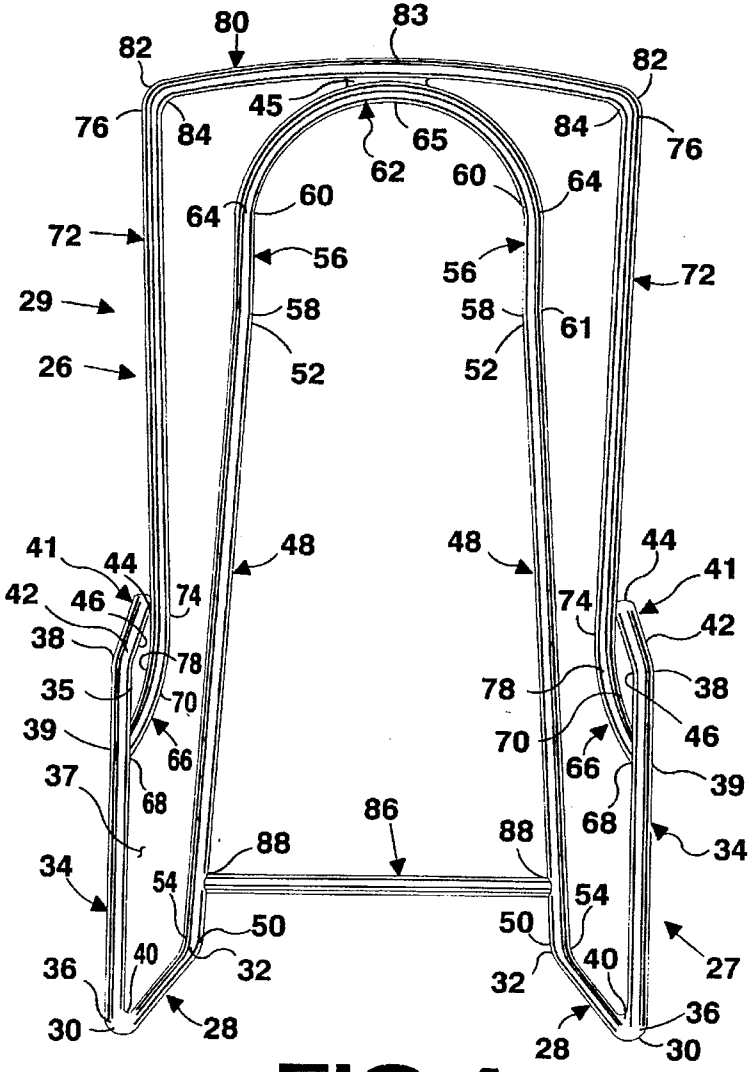
FIG. 4 is a diagrammatic front elevational view of the present invention, with parts broken away, taken in the direction of arrow 4 in FIG. 2.
Figure 3:
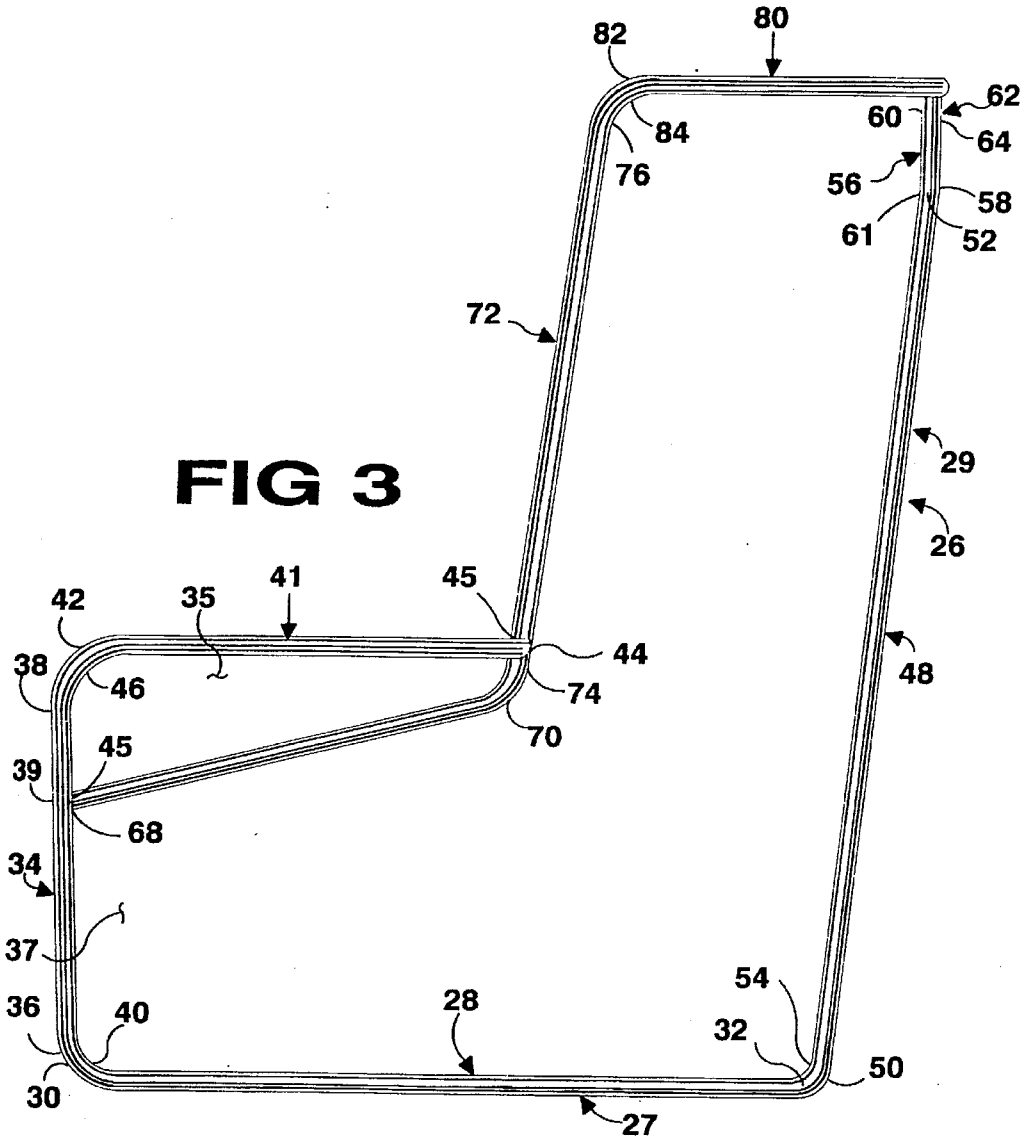
FIG. 3 is a diagrammatic side elevational view of the present invention, with parts broken away, taken in the direction of arrow 3 in FIG. 2.

10—sock donning assist device of the present invention
11—sock
12—sock lower portion
13—sock upper portion
14—user foot
15—user foot toe portion
16—user leg
18—user
20—pair of caretaker hands
22—caretaker hand forefinger
23—caretaker hand remaining fingers
24—caretaker
26—hollow rigid substantially L-shaped frame
27—frame horizontally-oriented user gripping portion
28—pair of frame lower side, straight, substantially parallel-disposed, spaced-apart, horizontally-oriented, elongated, and slender cylindrical members 28
29—frame vertically-oriented sock holding portion
30—frame lower side member front end
32—frame lower side member back end
34—pair of frame lower front, straight, substantially parallel-disposed, spaced-apart, substantially vertically-oriented, elongated, and slender cylindrical members
35—caretaker forefinger gripping space
36—frame lower front member lower end
37—caretaker remaining fingers gripping space
38—frame lower front member upper end
39—frame lower front member intermediate point
40—frame lower front smooth convex-shaped bend
41—pair of frame upper intermediate side, straight, substantially parallel-disposed, spaced-apart, horizontally-oriented, elongated, and slender cylindrical members
42—frame upper intermediate member front end
44—frame upper intermediate member back end
45—suitable fastening means
46—frame upper intermediate side smooth convex-shaped bend
48—pair of frame lower back, straight, slightly inwardly tapering, substantially vertically-oriented, elongated, and slender cylindrical members
50—frame lower back member lower end
52—frame lower back member upper end
54—frame lower back smooth convex-shaped bend
56—pair of frame intermediate back, straight, substantially parallel-disposed, spaced-apart, vertically-oriented, short, and slender cylindrical members
58—frame intermediate back member lower end
60—frame intermediate back member upper end
61—frame intermediate back smooth convex-shaped bend
62—frame upper back, semi-circular, vertically oriented, elongated, and slender connecting member
64—pair of frame upper back member ends
65—frame upper back member midway point
66—pair of frame lower intermediate side, straight, substantially parallel-disposed, skew-oriented, elongated, and slender cylindrical members
68—frame lower intermediate side member front end
70—frame lower intermediate side member back end
72—pair of frame upper front, straight, substantially parallel-disposed, spaced-apart, substantially vertically-oriented, elongated, and slender cylindrical members
74—frame upper front member lower end
76—frame upper front member upper end
78—frame lower intermediate side smooth concave-shaped bend
80—frame U-shaped top, horizontally oriented, forwardly opening, elongated, and slender member
82—pair of frame top member ends
83—frame top member midway point
84—frame upper front smooth convex-shaped bend
86—frame lower back, straight, horizontally-oriented, elongated, and slender cylindrical connecting member
88—pair of frame lower back connecting member ends

DETAILED DESCRIPTION OF THE PREFERRED EMBODIMENT

Referring now to the figures in which like numerals indicate like parts, and particularly to FIG. 1, the sock donning assist. device of the present invention is shown generally at 10 donning a sock 11, with a sock lower portion 12 and a sock upper portion 13, onto a user foot 14, with a user foot toe portion 15, of a user leg 16 of a user 18 by a pair of caretaker hands 20 of a caretaker 24 each of which having a caretaker hand forefinger 22 and a caretaker hand remaining fingers.

The configuration of the sock donning assist device 10 can best be seen in FIGS. 2 through 5, and as such, will be discussed with reference thereto.

The sock donning assist device 10 includes a hollow rigid substantially L-shaped frame 26 that can be made from metal or plastic, but is not limited to that, and consists of a plurality elongated and slender cylindrical members of specific lengths and shapes that form a frame horizontally-oriented caretaker gripping portion 27 and a frame vertically-oriented sock holding portion 29.

The hollow rigid substantially L-shaped frame 26 includes a pair of frame lower side, straight, substantially parallel-disposed, spaced-apart, horizontally-oriented, elongated, and slender cylindrical members 28. Each of the pair of frame lower side, straight, substantially parallel-disposed, spaced-apart, horizontally-oriented, elongated, and slender cylindrical members 28 of the hollow rigid substantially L-shaped frame 26 has a frame lower side member front end 30 and a frame lower side member back end 32.

The hollow rigid substantially L-shaped frame 26 further includes a pair of frame lower front, straight, substantially parallel-disposed, spaced-apart, substantially vertically-oriented, elongated, and slender cylindrical members 34. Each of the pair of frame lower front, straight, substantially parallel-disposed, spaced-apart, substantially vertically-oriented, elongated, and slender cylindrical members 34 of the hollow rigid substantially L-shaped frame 26 functions as a handle and has a frame lower front member lower end 36, a frame lower front member upper end 38, and a frame lower front member intermediate point 39.

The frame lower front member intermediate point 39 of each of the pair of frame lower front, substantially parallel-disposed, straight, spaced-apart, substantially vertically-oriented, elongated, and slender cylindrical members 34 of the hollow rigid substantially L-shaped frame 26 is positioned below the frame lower front member upper end 38 of each of the pair of frame lower front, straight, substantially parallel-disposed, spaced-apart, substantially vertically-oriented, elongated, and slender cylindrical members 34 of the hollow rigid substantially L-shaped frame 26 a distance equal to approximately one third the length of each of the pair of frame lower front, straight, substantially parallel-disposed, spaced-apart, substantially vertically-oriented, elongated, and slender cylindrical members 34 of the hollow rigid substantially L-shaped frame 26.

The positioning of the frame lower front member intermediate point 39 of each of the pair of frame lower front, substantially parallel-disposed, straight, spaced-apart, substantially vertically-oriented, elongated, and slender cylindrical members 34 of the hollow rigid substantially L-shaped frame 26 is strategic and forms a caretaker forefinger gripping space 35 and a caretaker remaining fingers gripping space 37.

Each of the pair of frame lower front, straight, substantially parallel-disposed, spaced-apart, substantially vertically-oriented, elongated, and slender cylindrical members 34 of the hollow rigid substantially L-shaped frame 26, at the frame lower front member lower end 36 of each of the pair of frame lower front, straight, substantially parallel-disposed, spaced-apart, substantially vertically-oriented, elongated, and slender cylindrical members 34 of the hollow rigid substantially L-shaped frame 26, extends smoothly upwardly at an obtuse angle, and slightly forwardly at an obtuse angle, from the frame lower side member front end 30 of each of the pair of frame lower side, straight, substantially parallel-disposed, spaced-apart, horizontally-oriented, elongated, and slender cylindrical members 28 of the hollow rigid substantially L-shaped frame 26 and together therewith forms a frame lower front smooth convex-shaped bend 40.

The pair of frame lower front, straight, substantially parallel-disposed, spaced-apart, substantially vertically-oriented, elongated, and slender cylindrical members 34 of the hollow rigid substantially L-shaped frame 26 are spaced-apart a distance substantially equal to the distance between the pair of frame lower side, straight, substantially parallel-disposed, spaced-apart, horizontally-oriented, elongated, and slender cylindrical members 28 of the hollow rigid substantially L-shaped frame 26.

Each of the pair of frame lower front, straight, substantially parallel-disposed, spaced-apart, substantially vertically-oriented, elongated, and slender cylindrical members 34 of the hollow rigid substantially L-shaped frame 26 has a length sufficient so as to be readily received by each of the pair of caretaker hands 20 of the pair of caretaker arms 22 of the caretaker 24 (see FIG. 1).

The hollow rigid substantially L-shaped frame 26 further includes a pair of frame upper intermediate side, straight, substantially parallel-disposed, spaced-apart, horizontally-oriented, elongated, and slender cylindrical members 41. Each of the pair of frame upper intermediate side, straight, substantially parallel-disposed, spaced-apart, horizontally-oriented, elongated, and slender cylindrical members 41 of the hollow rigid substantially L-shaped frame 26 has a frame upper intermediate side member front end 42 and a frame upper intermediate side member back end 44.

Each of the pair of frame upper intermediate side, straight, substantially parallel-disposed, spaced-apart, horizontally-oriented, elongated, and slender cylindrical members 41 of the hollow rigid substantially L-shaped frame 26, at the frame upper intermediate side member front end 42 of each of the pair of frame upper intermediate side, straight, substantially parallel-disposed, spaced-apart, horizontally-oriented, elongated, and slender cylindrical members 41 of the hollow rigid substantially L-shaped frame 26, extends smoothly rearwardly at an acute angle, from the frame lower front member upper end 38 of each of the pair of frame lower front, straight, substantially parallel-disposed, spaced-apart, substantially vertically-oriented, elongated, and slender cylindrical members 34 of the hollow rigid substantially L-shaped frame 26 and together therewith forms a frame upper intermediate side smooth convex-shaped bend 46.

The pair of frame upper intermediate side, straight, substantially parallel-disposed, spaced-apart, horizontally-oriented, elongated, and slender cylindrical members 41 of the hollow rigid substantially L-shaped frame 26 are spaced-apart a distance substantially equal to the distance between the pair of frame lower side, straight, substantially parallel-disposed, spaced-apart, horizontally-oriented, elongated, and slender cylindrical members 28 of the hollow rigid substantially L-shaped frame 26.

The pair of frame upper intermediate side, straight, substantially parallel-disposed, spaced-apart, horizontally-oriented, elongated, and slender cylindrical members 41 of the hollow rigid substantially L-shaped frame 26 are substantially parallel to, and displaced a distance above, the pair of frame lower side, straight, substantially parallel-disposed, spaced-apart, horizontally-oriented, elongated, and slender cylindrical members 28 of the hollow rigid substantially L-shaped frame 26.

Each of the pair of frame upper intermediate side, straight, substantially parallel-disposed, spaced-apart, horizontally-oriented, elongated, and slender cylindrical members 41 of the hollow rigid substantially L-shaped frame 26 has a length less than the length of each of the pair of frame lower side, straight, substantially parallel-disposed, spaced-apart, horizontally-oriented, elongated, and slender cylindrical members 28 of the hollow rigid substantially L-shaped frame 26.

The hollow rigid substantially L-shaped frame 26 further includes a pair of frame lower back, straight, slightly inwardly tapering, substantially vertically-oriented, elongated, and slender cylindrical members 48. Each of the pair of frame lower back, straight, slightly inwardly tapering, substantially vertically-oriented, elongated, and slender cylindrical members 48 of the hollow rigid substantially L-shaped frame 26 has a frame lower back member lower end 50 and a frame lower back member upper end 52.

Each of the pair of frame lower back, straight, slightly inwardly tapering, substantially vertically-oriented, elongated, and slender cylindrical members 48 of the hollow rigid substantially L-shaped frame 26, at the frame lower back member lower end 50 of each of the pair of frame lower back, straight, slightly inwardly tapering, substantially vertically-oriented, elongated, and slender cylindrical members 48 of the hollow rigid substantially L-shaped frame 26, extends smoothly upwardly at an obtuse angle, and slightly rearwardly at an obtuse angle, from the frame lower side member back end 32 of each of the pair of frame lower side, straight, substantially parallel-disposed, spaced-apart, horizontally-oriented, elongated, and slender cylindrical members 28 of the hollow rigid substantially L-shaped frame 26 and together therewith forms a frame lower back smooth convex-shaped bend 54.

The pair of frame lower back, straight, slightly inwardly tapering, substantially vertically-oriented, elongated, and slender cylindrical members 48 of the hollow rigid substantially L-shaped frame 26 are displaced a distance behind the pair of frame lower front, straight, substantially parallel-disposed, spaced-apart, substantially vertically-oriented, elongated, and slender cylindrical members 34 of the hollow rigid substantially L-shaped frame 26 and are displaced a distance behind the pair of frame upper intermediate side, straight, substantially parallel-disposed, spaced-apart, horizontally-oriented, elongated, and slender cylindrical members 41 of the hollow rigid substantially L-shaped frame 26.

Each of the pair of frame lower back, straight, slightly inwardly tapering, substantially vertically-oriented, elongated, and slender cylindrical members 48 of the hollow rigid substantially L-shaped frame 26 has a length greater than the length of each of the pair of frame lower front, straight, substantially parallel-disposed, spaced-apart, substantially vertically-oriented, elongated and slender cylindrical members 34 of the hollow rigid substantially L-shaped frame 26.

The hollow rigid substantially L-shaped frame 26 further includes a pair of frame intermediate back, straight, substantially parallel-disposed, spaced-apart, vertically-oriented, short, and slender cylindrical members 56. Each of the pair of frame intermediate back, straight, substantially parallel-disposed, spaced-apart, vertically-oriented, short, and slender cylindrical members 56 of the hollow rigid substantially L-shaped frame 26 has a frame intermediate back member lower end 58 and a frame intermediate back member upper end 60.

Each of the pair of frame intermediate back, straight, substantially parallel-disposed, spaced-apart, vertically-oriented, short, and slender cylindrical members 56 of the hollow rigid substantially L-shaped frame 26, at the frame intermediate back member lower end 58 of each of the pair of frame intermediate back, straight, substantially parallel-disposed, spaced-apart, vertically-oriented, short, and slender cylindrical members 56 of the hollow rigid substantially L-shaped frame 26, extends smoothly upwardly at an obtuse angle, from the frame lower back member upper end 52 of each of the pair of frame lower back, straight, slightly inwardly tapering, substantially vertically-oriented, elongated, and slender cylindrical members 48 of the hollow rigid substantially L-shaped frame 26 and together therewith forms a frame intermediate back smooth convex-shaped bend 61.

The pair of frame intermediate back, straight, substantially parallel-disposed, spaced-apart, vertically-oriented, short, and slender cylindrical members 56 of the hollow rigid substantially L-shaped frame 26 are displaced a distance behind the pair of frame lower front, straight, substantially parallel-disposed, spaced-apart, substantially vertically-oriented, elongated, and slender cylindrical members 34 of the hollow rigid substantially L-shaped frame 26 and are displaced a distance behind the pair of frame upper intermediate side, straight, substantially parallel-disposed, spaced-apart, horizontally-oriented, elongated, and slender cylindrical members 41 of the hollow rigid substantially L-shaped frame 26.

The hollow rigid substantially L-shaped frame 26 further includes a frame upper back, semi-circular, vertically oriented, elongated, and slender connecting member 62. The frame upper back, semi-circular, vertically oriented, elongated, and slender connecting member 62 of the hollow rigid substantially L-shaped frame 26 has a pair of frame upper back member ends 64 and a frame upper back member midway point 65.

The frame upper back, semi-circular, vertically oriented, elongated, and slender connecting member 62 of the hollow rigid substantially L-shaped frame 26, at each of the pair of frame upper back member ends 64 of the frame upper back, semi-circular, vertically oriented, elongated and slender member 62 of the hollow rigid substantially L-shaped frame 26, extends smoothly upwardly from each frame intermediate back member upper end 60 of each of the pair of frame intermediate back, straight, substantially parallel-disposed, spaced-apart, vertically-oriented, short, and slender cylindrical members 56 of the hollow rigid substantially L-shaped frame 26.

The frame upper back, semi-circular, vertically oriented, elongated, and slender connecting member 62 of the hollow rigid substantially L-shaped frame 26 is displaced a distance behind the pair of frame lower front, straight, substantially parallel-disposed, spaced-apart, substantially vertically-oriented, elongated, and slender cylindrical members 34 of the hollow rigid substantially L-shaped frame 26 and is displaced a distance behind the pair of frame upper intermediate side, straight, substantially parallel-disposed, spaced-apart, horizontally-oriented, elongated, and slender cylindrical members 41 of the hollow rigid substantially L-shaped frame 26.

The hollow rigid substantially L-shaped frame 26 further includes a pair of frame lower intermediate side, straight, substantially parallel-disposed, skew-oriented, elongated, and slender cylindrical members 66. Each of the pair of frame lower intermediate side, straight, substantially parallel-disposed, skew-oriented, elongated, and slender cylindrical members 66 has a frame lower intermediate side member front end 68 and a frame lower intermediate side member back end 70.

Each of the pair of frame lower intermediate side, straight, substantially parallel-disposed, skew-oriented, elongated, and slender cylindrical members 66 of the hollow rigid substantially L-shaped frame 26, at the frame lower intermediate side member front end of each of the pair of frame lower intermediate side, straight, substantially parallel-disposed, skew-oriented, elongated, and slender cylindrical members 66 of the hollow rigid substantially L-shaped frame 26, extend abruptly rearwardly and slightly upwardly at an obtuse angle, from the frame lower front member intermediate point 39 of each of the pair of frame lower front, straight, substantially parallel-disposed, spaced-apart, substantially vertically-oriented, elongated, and slender cylindrical members 34 of the hollow rigid substantially L-shaped frame 26 and are affixed thereto by suitable fastening means 45 that is compatible with the material of the sock donning assist device 10, such as, but not limited to, solder, epoxy or the like.

Each of the pair of frame lower intermediate side, straight, substantially parallel-disposed, skew-oriented, elongated, and slender cylindrical members 66 of the hollow rigid substantially L-shaped frame 26 are displaced a distance above, and in the same vertical plane as, each of the pair of frame lower side, straight, substantially parallel-disposed, spaced-apart, horizontally-oriented, elongated, and slender cylindrical members 28 of the hollow rigid substantially L-shaped frame 26 and are displaced a distance below, and in the same vertical plane as, each of the pair of frame upper intermediate side, straight, substantially parallel-disposed, spaced-apart, horizontally-oriented, elongated, and slender cylindrical members 41 of the hollow rigid substantially L-shaped frame 26.

Each of the pair of frame lower intermediate side, straight, substantially parallel-disposed, skew-oriented, elongated and slender cylindrical members 66 of the hollow rigid substantially L-shaped frame 26 has a length less than the length of each of the pair of frame lower side, straight, substantially parallel-disposed, spaced-apart, horizontally-oriented, elongated, and slender cylindrical members 28 of the hollow rigid substantially L-shaped frame 26 and has a length greater than the length of the pair of frame upper intermediate side, straight, substantially parallel-disposed, spaced-apart, horizontally-oriented, elongated, and slender cylindrical members 41 of the hollow rigid substantially L-shaped frame 26.

The hollow rigid substantially L-shaped frame 26 further includes a pair of frame upper front, straight, substantially parallel-disposed, spaced-apart, substantially vertically-oriented, elongated, and slender cylindrical members 72. Each of the pair of frame upper front, straight, substantially parallel-disposed, spaced-apart, substantially vertically-oriented, elongated, slender cylindrical members 72 has a frame upper front member lower end 74 and a frame upper front member upper end 76.

Each of the pair of frame upper front, straight, substantially parallel-disposed, spaced-apart, substantially vertically-oriented, elongated, and slender cylindrical members 72 of the hollow rigid substantially L-shaped frame 26, at the frame upper front member lower end 74 of each of the pair of frame upper front, straight, substantially parallel-disposed, spaced-apart, substantially vertically-oriented, elongated, and slender cylindrical members 72 of the hollow rigid substantially L-shaped frame 26, extend smoothly upwardly and slightly rearwardly at an obtuse angle, from the frame lower intermediate side member back end 70 of the pair of frame lower intermediate side, straight, substantially parallel-disposed, skew-oriented, elongated, and slender cylindrical members 66 of the hollow rigid substantially L-shaped frame 26 and together therewith forms a frame lower intermediate side smooth concave-shaped bend 78.

The pair of frame upper front, straight, substantially parallel-disposed, spaced-apart, substantially vertically-oriented, elongated, and slender cylindrical members 72 of the hollow rigid substantially L-shaped frame 26 are substantially parallel to, and displaced a distance forward of, the pair of frame lower back, straight, slightly inwardly tapering, substantially vertically-oriented, elongated, and slender cylindrical members 48 of the hollow rigid substantially L-shaped frame 26 and are displaced a distance rearward of the pair of frame lower front, straight, substantially parallel-disposed, spaced-apart, substantially vertically-oriented, elongated, and slender cylindrical members 34 of the hollow rigid substantially L-shaped frame 26.

Each of the pair of frame upper front, straight, substantially parallel-disposed, spaced-apart, substantially vertically-oriented, elongated, and slender cylindrical members 72 of the hollow rigid substantially L-shaped frame 26 has a length less than the length of each of the pair of frame lower back, straight, slightly inwardly tapering, substantially vertically-oriented, elongated, and slender cylindrical members 48 of the hollow rigid substantially L-shaped frame 26.

The frame upper intermediate side member back end 44 of each of the pair of frame upper intermediate side, straight, substantially parallel-disposed, spaced-apart, horizontally-oriented, elongated, and slender cylindrical members 41 of the hollow rigid substantially L-shaped frame 26 abruptly meets at an obtuse angle, the frame upper front member lower end 74 of each of the pair of frame upper front, straight, substantially parallel-disposed, spaced-apart, substantially vertically-oriented, elongated, and slender cylindrical members 72 of the hollow rigid substantially L-shaped frame 26 and are affixed thereto by the suitable fastening means 45.

The hollow rigid substantially L-shaped frame 26 further includes a frame U-shaped top, horizontally oriented, forwardly opening, elongated, and slender member 80. The frame U-shaped top, horizontally oriented, forwardly opening, elongated, and slender member 80 of the hollow rigid substantially L-shaped frame 26 has a pair of frame top member ends 82 and a frame top member midway point 83.

The frame U-shaped top, horizontally oriented, forwardly opening, elongated, and slender member 80 of the hollow rigid substantially L-shaped frame 26, at the pair of frame top member ends 82 of the frame U-shaped top, horizontally oriented, forwardly opening, elongated, and slender member 80 of the hollow rigid substantially L-shaped frame 26, extends smoothly rearwardly at an obtuse angle, from each frame upper front member upper end 76 of each of the pair of frame upper front, straight, substantially parallel-disposed, spaced-apart, substantially vertically-oriented, elongated, and slender cylindrical members 72 of the hollow rigid substantially L-shaped frame 26 and together therewith forms a frame upper front smooth convex-shaped bend 84.

The frame U-shaped top, horizontally oriented, forwardly opening, elongated, and slender member 80 of the hollow rigid substantially L-shaped frame 26 is substantially parallel to, and displaced a distance above both, the pair of frame lower side, straight, substantially parallel-disposed, spaced-apart, horizontally-oriented, elongated, and slender cylindrical members 28 of the hollow rigid substantially L-shaped frame 26 and is displaced a distance above the pair of frame upper intermediate side, straight, substantially parallel-disposed, spaced-apart, horizontally-oriented, elongated, and slender cylindrical members 41 of the hollow rigid substantially L-shaped frame 26.

The frame U-shaped top, horizontally oriented, elongated, and slender member 80 of the hollow rigid substantially L-shaped frame 26 has a span less than the length of the pair of frame lower side, straight, substantially parallel-disposed, spaced-apart, horizontally-oriented, elongated, and slender cylindrical members 28 of the hollow rigid substantially L-shaped frame 26.

The frame top member midway point 83 of the frame U-shaped top, horizontally oriented, elongated, and slender member 80 of the hollow rigid substantially L-shaped frame 26 is affixed to the frame upper back member midway point 65 of the frame upper back semi-circular, vertically oriented, elongated, and slender member 62 of the hollow rigid substantially L-shaped frame 26, by the suitable fastening means 45.

The hollow rigid substantially L-shaped frame 26 further includes a frame lower back, straight, horizontally-oriented, elongated, and slender cylindrical connecting member 86. The frame lower back, straight, horizontally-oriented, elongated, and slender cylindrical connecting member 86 of the hollow rigid substantially L-shaped frame 26 has a pair of frame lower back connecting member ends 88.

The frame lower back, straight, horizontally-oriented, elongated, and slender cylindrical connecting member 86 of the hollow rigid substantially L-shaped frame 26, at the pair of frame lower back connecting member ends 88 of the frame lower back, straight, horizontally-oriented, elongated and slender member 86 of the hollow rigid substantially L-shaped frame 26, extends smoothly at a right angle, from the area in proximity to each of the frame lower back member lower end 50 of each of the pair of frame lower back, straight, slightly inwardly tapering, substantially vertically-oriented, elongated, and slender cylindrical members 48 of the hollow rigid substantially L-shaped frame 26.

The frame lower back, straight, horizontally-oriented, elongated, and slender cylindrical connecting member 86 of the hollow rigid substantially L-shaped frame 26 is displaced a distance behind the pair of frame lower front, straight, substantially parallel-disposed, spaced-apart, substantially vertically-oriented, elongated, and slender cylindrical members 34 of the hollow rigid substantially L-shaped frame 26 and is displaced a distance behind the pair of frame upper intermediate side, straight, substantially parallel-disposed, spaced-apart, horizontally-oriented, elongated, and slender cylindrical members 41 of the hollow rigid substantially L-shaped frame 26.

The operation of the sock donning assist device 10 can best be seen in FIGS. 1 and 2, and as such, will be discussed with reference thereto.

As shown in FIG. 2, the sock lower portion 12 of the sock 11 is placed through the frame U-shaped top, horizontally oriented, forwardly opening, elongated, and slender member 80 of the frame vertically-oriented sock holding portion 29 of the hollow rigid substantially L-shaped frame 26 with the sock lower portion 12 of the sock 11 positioned in the interior space of the frame vertically-oriented sock holding portion 29 of the hollow rigid substantially L-shaped frame 26.

The sock upper portion 13 of the sock 11 is stretched over the frame U-shaped top, horizontally oriented, forwardly opening, elongated, and slender member 80 of the frame vertically-oriented sock holding portion 29 of the hollow rigid substantially L-shaped frame 26.

The sock upper portion 13 of the sock 11 is then pulled down over the exterior of the frame vertically-oriented sock holding portion 29 of the hollow rigid substantially L-shaped frame 26 and released so as to be compressingly secured thereto and ready for the caretaker 24 to apply.

As shown in FIG. 1, the caretaker hand forefinger 22 of each of the pair of caretaker hands 20 of the caretaker 24 enters each caretaker forefinger gripping space 35 and is bent around each of the pair of frame lower front, straight, substantially parallel-disposed, spaced-apart, substantially vertically-oriented, elongated, and slender cylindrical members 34 of the hollow rigid substantially L-shaped frame 26 in a securely gripping fashion.

The caretaker hand remaining fingers 23 of each of the pair of caretaker hands 20 of the caretaker 24 enters each caretaker remaining finger gripping space 37 and are bent around each of the pair of frame lower front, straight, substantially parallel-disposed, spaced-apart, substantially vertically-oriented, elongated, and slender cylindrical members 34 of the hollow rigid substantially L-shaped frame 26 in a securely gripping fashion.

The presence of each of the pair of frame upper intermediate side, straight, substantially parallel-disposed, spaced-apart, horizontally-oriented, elongated, and slender cylindrical members 41 of the hollow rigid substantially L-shaped frame 26 being positioned in between the caretaker hand forefinger 22 of each of the pair of caretaker hands 20 of the caretaker 24 and the caretaker hand remaining forefingers 23 of each of the pair of caretaker hands 20 of the caretaker 24 increases gripping ability and reduces unwanted rotation of the sock donning assist device 10 during use.

The user foot toe portion 15 of the user foot 14 of the user leg 16 of the user 18 is inserted into the sock lower portion 12 of the sock 11.

The combination sock donning assist device 10 and the sock 11 is gently pushed upwards on the user leg 16 of the user 18.

The sock upper portion 13 of the sock 11 pulls up and off the exterior of the frame vertically-oriented sock holding portion 29 of the hollow rigid substantially L-shaped frame 26 and becomes compressingly secured to the user foot 24 of the user leg 16 of the user 18.

The sock donning assist device 10 is then removed with the user foot 14 of the user leg 16 of the user 19, or in cases of high socks the user leg 16 of the user 19, leaving the frame U-shaped top, horizontally oriented, forwardly opening, elongated, and slender member 80 of the frame vertically-oriented sock holding portion 29 of the hollow rigid substantially L-shaped frame 26.

It will be understood that each of the elements described above, or two or more together, may also find a useful application in other types of constructions differing from the types described above.

While the invention has been illustrated and described as embodied in a sock donning assist device, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A sock donning assist device comprising a hollow rigid substantially L-shaped frame consisting of a plurality of different sized and shaped slender members and having a substantially vertically-oriented portion for retaining a sock during donning wherein the sock has an upper portion and a lower portion, and a horizontally-oriented portion extending forwardly from said substantially vertically-oriented portion of said hollow rigid substantially L-shaped frame for gripping by a user during donning the sock, so that prior to donning the sock said substantially vertically-oriented portion of said hollow rigid substantially L-shaped frame receives the lower portion of the sock and said substantially vertically-oriented portion of said hollow rigid substantially L-shaped frame is received by the upper portion of the sock and during donning said substantially vertically-oriented portion of said hollow rigid substantially L-shaped frame is progressively removed from the upper portion of the sock; said horizontally-oriented portion of said hollow rigid substantially L-shaped frame including a pair of lower side, straight, substantially parallel-disposed, spaced-apart, horizontally-oriented, elongated, and slender members; each of said pair of lower side, straight, substantiality parallel-disposed, spaced-apart, horizontally-oriented, elongated, and slender members of said horizontally-oriented portion of said hollow rigid substantially L-shaped frame having a front end, a back end, and a length.

2. The device as defined in claim 1, wherein said hollow rigid substantially L-shaped frame is selected from the group consisting of metal and plastic.

3. The device as defined in claim 1, wherein said horizontally-oriented portion of said hollow rigid substantially L-shaped frame further includes a pair of lower front, straight, substantially parallel-disposed, spaced-apart, substantially vertically-oriented, elongated, and slender members, each of said pair of lower front, straight, substantially parallel-disposed, spaced-apart, substantially vertically-oriented, elongated, and slender members of said horizontally-oriented portion of said hollow rigid substantially L-shaped frame is a gripping handle and has a lower end, an upper end, an intermediate point, and a length, each of said pair of lower front, straight, substantially parallel-disposed, spaced-apart, substantially vertically-oriented, elongated, and slender members of said horizontally-oriented portion of said hollow rigid substantially L-shaped frame extend at said lower end of each of said pair of lower front, straight, substantially parallel-disposed, spaced-apart, substantially vertically-oriented, elongated, and slender members of said horizontally-oriented portion of said hollow rigid substantially L-shaped frame smoothly upwardly at an obtuse angle and slightly forwardly at an obtuse angle from said front end of each of said pair of lower side, straight, substantially parallel-disposed, spaced-apart, horizontally-oriented, elongated, and slender members of said horizontally-oriented portion of said hollow rigid substantially L-shaped frame and together therewith forms a smooth convex-shaped bend, said pair of lower front, straight, substantially parallel-disposed, spaced-apart, substantially vertically-oriented, elongated, and slender members of said horizontally-oriented portion of said hollow rigid substantially L-shaped frame are spaced-apart a distance substantially equal to the distance between said pair of lower side, straight, substantially parallel-disposed, spaced-apart, horizontally-oriented, elongated, and slender members of said horizontally-oriented portion of said hollow rigid substantially L-shaped frame.

4. The device as defined in claim 3, wherein said horizontally-oriented portion of said hollow rigid substantially L-shaped frame further includes a pair of upper intermediate side, straight, substantially parallel-disposed, spaced-apart, horizontally-oriented, elongated, and slender members, each of said pair of upper intermediate side, straight, substantially parallel-disposed, spaced-apart, horizontally-oriented, elongated, and slender members of said horizontally-oriented portion of said hollow rigid substantially L-shaped frame has a front end, a back end, and a length, each of said pair of upper intermediate side, straight, substantially parallel-disposed, spaced-apart, horizontally-oriented, elongated, and slender members of said horizontally-oriented portion of said hollow rigid substantially L-shaped frame extend at said front end of each of said pair of upper intermediate side, straight, substantially parallel-disposed, spaced-apart, horizontally-oriented, elongated, and slender members of said horizontally-oriented portion of said hollow rigid substantially L-shaped frame smoothly rearwardly at an acute angle from said upper end of each of said pair of lower front, straight, substantially parallel-disposed, spaced-apart, substantially vertically-oriented, elongated, and slender members of said horizontally-oriented portion of said hollow rigid substantially L-shaped frame and together therewith forms a smooth convex-shaped bend, said pair of upper intermediate side, straight, substantially parallel-disposed, spaced-apart, horizontally-oriented, elongated, and slender members of said horizontally-oriented portion of said hollow rigid substantially L-shaped frame are spaced-apart a distance substantially equal to the distance between said pair of lower side, straight, substantially parallel-disposed, spaced-apart, horizontally-oriented, elongated, and slender members of said horizontally-oriented portion of said hollow rigid substantially L-shaped frame, said pair of upper intermediate side, straight, substantially parallel-disposed, spaced-apart, horizontally-oriented, elongated, and slender members of said horizontally-oriented portion of said hollow rigid substantially L-shaped frame are substantially parallel to, and displaced a distance above, said pair of lower side, straight, substantially parallel-disposed, spaced-apart, horizontally-oriented, elongated, and slender members of said horizontally-oriented portion of said hollow rigid substantially L-shaped frame, said length of each of said pair of upper intermediate side, straight, substantially parallel-disposed, spaced-apart, horizontally-oriented, elongated, and slender members of said horizontally-oriented portion of said hollow rigid substantially L-shaped frame is less than said length of each of said pair of lower side, straight, substantially parallel-disposed, spaced-apart, horizontally-oriented, elongated, and slender members of said horizontally-oriented portion of said hollow rigid substantially L-shaped frame.

5. The device as defined in claim 4, wherein said horizontally-oriented portion of said hollow rigid substantially L-shaped frame further includes a pair of upper intermediate side, straight, substantially parallel-disposed, spaced-apart, horizontally-oriented, elongated, and slender members, each of said pair of upper intermediate side, straight, substantially parallel-disposed, spaced-apart, horizontally-oriented, elongated, and slender members of said horizontally-oriented portion of said hollow rigid substantially L-shaped frame has a front end, a back end, and a length, each of said pair of upper intermediate side, straight, substantially parallel-disposed, spaced-apart, horizontally-oriented, elongated, and slender members of said horizontally-oriented portion of said hollow rigid substantially L-shaped frame extend at said front end of each of said pair of upper intermediate side, straight, substantially parallel-disposed, spaced-apart, horizontally-oriented, elongated, and slender members of said horizontally-oriented portion of said hollow rigid substantially L-shaped frame smoothly rearwardly at an acute angle from said upper end of each of said pair of lower front, straight, substantially parallel-disposed, spaced-apart, substantially vertically-oriented, elongated, and slender members of said horizontally-oriented portion of said hollow rigid substantially L-shaped frame and together therewith forms a smooth concave-shaped bend, said pair of upper intermediate side, straight, substantially parallel-disposed, spaced-apart, horizontally-oriented, elongated, and slender members of said horizontally-oriented portion of said hollow rigid substantially L-shaped frame are spaced-apart a distance substantially equal to the distance between said pair of lower side, straight, substantially parallel-disposed, spaced-apart, horizontally-oriented, elongated, and slender members of said horizontally-oriented portion of said hollow rigid substantially L-shaped frame, said pair of upper intermediate side, straight, substantially parallel-disposed, spaced-apart, horizontally-oriented, elongated, and slender members of said horizontally-oriented portion of said hollow rigid substantially L-shaped frame are substantially parallel to, and displaced a distance above, said pair of lower side, straight, substantially parallel-disposed, spaced-apart, horizontally-oriented, elongated, and slender members of said horizontally-oriented portion of said hollow rigid substantially L-shaped frame, said length of each of said pair of upper intermediate side, straight, substantially parallel-disposed, spaced-apart, horizontally-oriented, elongated, and slender members of said horizontally-oriented portion of said hollow rigid substantially L-shaped frame is less than said length of each of said pair of lower side, straight, substantially parallel-disposed, spaced-apart, horizontally-oriented, elongated, and slender members of said horizontally-oriented portion of said hollow rigid substantially L-shaped frame.

6. The device as defined in claim 5, wherein said substantially vertically-oriented portion of said hollow rigid substantially L-shaped frame includes a pair of lower back, straight, slightly inwardly tapering, substantially vertically-oriented, elongated, and slender members, each of said pair of lower back, straight, slightly inwardly tapering, substantially vertically-oriented, elongated, and slender members of said substantially vertically-oriented portion of the hollow rigid substantially L-shaped frame has a lower end, an upper end, and a length, each of said pair of lower back, straight, slightly inwardly tapering, substantially vertically-oriented, elongated, and slender members of said substantially vertically-oriented portion of said hollow rigid substantially L-shaped frame extend at said lower end of each of said pair of lower back, straight, slightly inwardly tapering, substantially vertically-oriented, elongated, and slender members of said substantially vertically-oriented portion of said hollow rigid substantially L-shaped frame smoothly upwardly at an obtuse angle and slightly rearwardly at an obtuse angle from said back end of each of said pair of lower side, straight, substantially parallel-disposed, spaced-apart, horizontally-oriented, elongated, and slender members of said horizontally-oriented portion of said hollow rigid substantially L-shaped frame and together therewith forms a smooth convex-shaped bend, said pair of lower back, straight, slightly inwardly tapering, substantially vertically-oriented, elongated, and slender members of said substantially vertically-oriented portion of said hollow rigid substantially L-shaped frame are displaced a distance behind said pair of lower front, straight, substantially parallel-disposed, spaced-apart, substantially vertically-oriented, elongated, and slender members of said horizontally-oriented portion of said hollow rigid substantially L-shaped frame and are displaced a distance behind said pair of upper intermediate side, straight, substantially parallel-disposed, spaced-apart, horizontally-oriented, elongated, and slender members of said horizontally-oriented portion of said hollow rigid substantially L-shaped frame, said length of each of said pair of lower back, straight, slightly inwardly tapering, substantially vertically-oriented, elongated, and slender members of said substantially vertically-oriented portion of said hollow rigid substantially L-shaped frame is greater than said length of each of said pair of lower front, straight, substantially parallel-disposed, spaced-apart, substantially vertically-oriented, elongated and slender members of said horizontally-oriented portion of said hollow rigid substantially L-shaped frame.

7. The device as defined in claim 6, wherein said substantially vertically-oriented portion of said hollow rigid substantially L-shaped frame further includes a pair of intermediate back, straight, substantially parallel-disposed, spaced-apart, vertically-oriented, short, and slender members, each of said pair of intermediate back, straight, substantially parallel-disposed, spaced-apart, vertically-oriented, short, and slender members of said substantially vertically-oriented portion of said hollow rigid substantially L-shaped frame has a lower end, an upper end, and a length, each of said pair of intermediate back, straight, substantially parallel-disposed, spaced-apart, vertically-oriented, short, and slender members of said substantially vertically-oriented portion of said hollow rigid substantially L-shaped frame extend at said lower end of each of said pair of intermediate back, straight, substantially parallel-disposed, spaced-apart, vertically-oriented, short, and slender members of said substantially vertically-oriented portion of said hollow rigid substantially L-shaped frame smoothly upwardly at an obtuse angle from said upper end of each of said pair of lower back, straight, slightly inwardly tapering, substantially vertically-oriented, elongated, and slender members of said substantially vertically-oriented portion of said hollow rigid substantially L-shaped frame and together therewith forms a smooth convex-shaped bend, said pair of intermediate back, straight, substantially parallel-disposed, spaced-apart, vertically-oriented, short, and slender members of said vertically-oriented portion of said hollow rigid substantially L-shaped frame are displaced a distance behind said pair of lower front, straight, substantially parallel-disposed, spaced-apart, substantially vertically-oriented, elongated, and slender members of said horizontally-oriented portion of said hollow rigid substantially L-shaped frame and are displaced a distance behind said pair of upper intermediate side, straight, substantially parallel-disposed, spaced-apart, horizontally-oriented, elongated, and slender members of said horizontally-oriented portion of said hollow rigid substantially L-shaped frame.

8. The device as defined in claim 7, wherein said substantially vertically-oriented portion of said hollow rigid substantially L-shaped frame further includes an upper back, semi-circular, vertically oriented, elongated, and slender connecting member, said upper back, semi-circular, vertically oriented, elongated, and slender connecting member of said substantially vertically-oriented portion of said hollow rigid substantially L-shaped frame has a pair of ends, a midway point, and a span, said upper back, semi-circular, vertically oriented, elongated, and slender connecting member of said vertically-oriented portion of said hollow rigid substantially L-shaped frame extends at each of said pair of ends of said upper back, semi-circular, vertically oriented, elongated and slender member of said substantially vertically-oriented portion of said hollow rigid substantially L-shaped frame smoothly upwardly from said upper end of each of said pair of intermediate back, straight, substantially parallel-disposed, spaced-apart, vertically-oriented, short, and slender members of said vertically-oriented portion of said hollow rigid substantially L-shaped frame, said upper back, semi-circular, vertically oriented, elongated, and slender connecting member of said substantially vertically-oriented portion of said hollow rigid substantially L-shaped frame is displaced a distance behind said pair of lower front, straight, substantially parallel-disposed, spaced-apart, substantially vertically-oriented, elongated, and slender members of said horizontally-oriented portion of said hollow rigid substantially L-shaped frame and is displaced a distance behind said pair of upper intermediate side, straight, substantially parallel-disposed, spaced-apart, horizontally-oriented, elongated, and slender members of said horizontally-oriented portion of said hollow rigid substantially L-shaped frame.

9. The device as defined in claim 8, wherein said horizontally-oriented portion of said hollow rigid substantially L-shaped frame further includes a pair of lower intermediate side, straight, substantially parallel-disposed, skew-oriented, elongated, and slender members, each of said pair of lower intermediate side, straight, substantially parallel-disposed, skew-oriented, elongated, and slender members of said horizontally-oriented portion of said hollow rigid substantially L-shaped frame has a front end, a back end, and a length, each of said pair of lower intermediate side, straight, substantially parallel-disposed, skew-oriented, elongated, and slender members of said horizontally-oriented portion of said hollow rigid substantially L-shaped frame extend at said front end of each of said pair of lower intermediate side, straight, substantially parallel-disposed, skew-oriented, elongated, and slender members of said horizontally-oriented portion of said hollow rigid substantially L-shaped frame abruptly rearwardly and slightly upwardly at an obtuse angle from said intermediate point of each of said pair of lower front, straight, substantially parallel-disposed, spaced-apart, substantially vertically-oriented, elongated, and slender members of said horizontally-oriented portion of said hollow rigid substantially L-shaped frame, each of said pair of lower intermediate side, straight, substantially parallel-disposed, skew-oriented, elongated, and slender members of said horizontally-oriented portion of said hollow rigid substantially L-shaped frame are displaced a distance above, and in the same vertical plane as, each of said pair of lower side, straight, substantially parallel-disposed, spaced-apart, horizontally-oriented, elongated, and slender members of said horizontally-oriented portion of said hollow rigid substantially L-shaped frame and are displaced a distance below, and in the same vertical plane as, each of said pair of upper intermediate side, straight, substantially parallel-disposed, spaced-apart, horizontally-oriented, elongated, and slender members of said horizontally-oriented portion of said hollow rigid substantially L-shaped frame, said length of each of said pair of lower intermediate side, straight, substantially parallel-disposed, skew-oriented, elongated and slender members of said horizontally-oriented portion of said hollow rigid substantially L-shaped frame is less than said length of each of said pair of lower side, straight, substantially parallel-disposed, spaced-apart, horizontally-oriented, elongated, and slender members of said horizontally-oriented portion of said hollow rigid substantially L-shaped frame and greater than said length of said pair of upper intermediate side, straight, substantially parallel-disposed, spaced-apart, horizontally-oriented, elongated, and slender members of said horizontally-oriented portion of said hollow rigid substantially L-shaped frame.

10. The device as defined in claim 9, wherein said front end of each of said pair of lower intermediate side, straight, substantially parallel-disposed, skew-oriented, elongated, and slender members of said horizontally-oriented portion of said hollow rigid substantially L-shaped frame is affixed to said intermediate point of each of said pair of lower front, straight, substantially parallel-disposed, spaced-apart, substantially vertically-oriented, elongated, and slender members of said horizontally-oriented portion of said hollow rigid substantially L-shaped frame by suitable fastening means that is compatible with the material of said sock donning assist device.

11. The device as defined in claim 10, wherein said substantially vertically-oriented portion of said hollow rigid substantially L-shaped frame further includes a pair of upper front, straight, substantially parallel-disposed, spaced-apart, substantially vertically-oriented, elongated, and slender members, each of said pair of upper front, straight, substantially parallel-disposed, spaced-apart, substantially vertically-oriented, elongated, slender members of said substantially vertically-oriented portion of said hollow rigid substantially L-shaped frame has a lower end, an upper end, and a length, each of said pair of upper front, straight, substantially parallel-disposed, spaced-apart, substantially vertically-oriented, elongated, and slender members of said vertically oriented portion of said hollow rigid substantially L-shaped frame extend at said lower end of each of said pair of upper front, straight, substantially parallel-disposed, spaced-apart, substantially vertically-oriented, elongated, and slender members of said substantially vertically-oriented portion of said hollow rigid substantially L-shaped frame smoothly upwardly and slightly rearwardly at an obtuse angle from said back end of each of said pair of lower intermediate side, straight, substantially parallel-disposed, skew-oriented, elongated, and slender members of said horizontally-oriented portion of said hollow rigid substantially L-shaped frame and together therewith forms a smooth concave-shaped, said pair of upper front, straight, substantially parallel-disposed, spaced-apart, substantially vertically-oriented, elongated, and slender members of said vertically-oriented portion of said hollow rigid substantially L-shaped frame are substantially parallel to, and displaced a distance forward of, said pair of lower back, straight, slightly inwardly tapering, substantially vertically-oriented, elongated, and slender members of said substantially vertically-oriented portion of said hollow rigid substantially L-shaped frame and are displaced a distance rearward of said pair of lower front, straight, substantially parallel-disposed, spaced-apart, substantially vertically-oriented, elongated, and slender members of said horizontally-oriented portion of said hollow rigid substantially L-shaped frame, said length of each of said pair of upper front, straight, substantially parallel-disposed, spaced-apart, substantially vertically-oriented, elongated, and slender members of said substantially vertically-oriented portion of said hollow rigid substantially L-shaped frame is less than said length of each of said pair of lower back, straight, slightly inwardly tapering, substantially vertically-oriented, elongated, and slender members of said vertically-oriented portion of said hollow rigid substantially L-shaped frame.

12. The device as defined in claim 11, wherein said back end of each of said pair of upper intermediate side, straight, substantially parallel-disposed, spaced-apart, horizontally-oriented, elongated, and slender members of said horizontally-oriented portion of said hollow rigid substantially L-shaped frame abruptly meets at an obtuse angle, said lower end of each of said pair of upper front, straight, substantially parallel-disposed, spaced-apart, substantially vertically-oriented, elongated, and slender members of said substantially vertically-oriented portion of said hollow rigid substantially L-shaped frame and are affixed thereto by said suitable fastening means.

13. The device as defined in claim 12, wherein said substantially vertically-oriented portion of said hollow rigid substantially L-shaped frame further includes a U-shaped top, horizontally-oriented, forwardly opening, elongated, and slender member, said U-shaped top, horizontally-oriented, forwardly opening, elongated, and slender member of said vertically-oriented portion of said hollow rigid substantially L-shaped frame has a ends, a midway point, and a span, said U-shaped top, horizontally oriented, forwardly opening, elongated, and slender member of said substantially vertically-oriented portion of said hollow rigid substantially L-shaped frame extends at said pair of ends of said U-shaped top, horizontally oriented, forwardly opening, elongated, and slender member of said substantially vertically-oriented portion of said hollow rigid substantially L-shaped frame smoothly rearwardly at an obtuse angle from said upper end of each of said pair of upper front, straight, substantially parallel-disposed, spaced-apart, substantially vertically-oriented, elongated, and slender members of said vertically-oriented portion of said hollow rigid substantially L-shaped frame and together therewith forms a smooth convex-shaped bend, said U-shaped top, horizontally oriented, forwardly opening, elongated, and slender member of said substantially vertically-oriented portion of said hollow rigid substantially L-shaped frame is substantially parallel to, and displaced a distance above, said pair of lower side, straight, substantially parallel-disposed, spaced-apart, horizontally-oriented, elongated, and slender members of said horizontally-oriented portion of said hollow rigid substantially L-shaped frame and is displaced a distance above said pair of upper intermediate side, straight, substantially parallel-disposed, spaced-apart, horizontally-oriented, elongated, and slender members of said horizontally-oriented portion of said hollow rigid substantially L-shaped frame, said span of said U-shaped top, horizontally oriented, elongated, and slender member of said substantially vertically-oriented portion of said hollow rigid substantially L-shaped frame is less than said length of said pair of lower side, straight, substantially parallel-disposed, spaced-apart, horizontally-oriented, elongated, and slender members of said horizontally-oriented of said hollow rigid substantially L-shaped frame.

14. The device as defined in claim 13, wherein said midway point of said U-shaped top, horizontally oriented, elongated, and slender member of said substantially vertically-oriented portion of said hollow rigid substantially L-shaped frame is affixed to said midway point of said upper back semi-circular, vertically oriented, elongated, and slender member of said substantially vertically-oriented portion of said hollow rigid substantially L-shaped frame, by said suitable fastening means.

15. The device as defined in claim 14, wherein said substantially vertically-oriented portion of said hollow rigid substantially L-shaped frame further includes a lower back, straight, horizontally-oriented, elongated, and slender connecting member, said lower back, straight, horizontally-oriented, elongated, and slender connecting member of said substantially vertically-oriented portion of said hollow rigid substantially L-shaped frame has a pair of ends, and a length, said lower back, straight, horizontally-oriented, elongated, and slender connecting member of said substantially vertically-oriented portion of said hollow rigid substantially L-shaped frame extends at said pair of ends of said lower back, straight, horizontally-oriented, elongated and slender member of said substantially vertically-oriented portion of said hollow rigid substantially L-shaped frame smoothly at a right angle from an area in proximity to said lower end of each of said pair of lower back, straight, slightly inwardly tapering, substantially vertically-oriented, elongated, and slender members of said vertically-oriented portion of said hollow rigid substantially L-shaped frame, said lower back, straight, horizontally-oriented, elongated, and slender connecting member of said substantially vertically-oriented portion of said hollow rigid substantially L-shaped frame is displaced a distance behind said pair of lower front, straight, substantially parallel-disposed, spaced-apart, substantially vertically-oriented, elongated, and slender members of said horizontally-oriented portion of said hollow rigid substantially L-shaped frame.

16. A method of using a sock donning assist device, said device comprising a hollow rigid substantially L-shaped frame comprising a substantially vertically-oriented portion with an interior space, an exterior, and a U-shaped top, horizontally oriented, forwardly opening, elongated, and slender member, said hollow rigid substantially L-shaped frame further comprising a horizontally-oriented portion with a pair of lower front, straight, substantially parallel-disposed, spaced-apart, substantially vertically-oriented, elongated, and slender members and pair of lower intermediate side, straight, substantially parallel-disposed, skew-oriented, elongated, and slender members, comprising the steps of:

a) placing a lower portion of a sock through said U-shaped top, horizontally oriented, forwardly opening, elongated, and slender member of said substantially vertically-oriented portion of said hollow rigid substantially L-shaped frame of said sock donning assist device with the lower portion of the sock positioned in said interior space of said substantially vertically-oriented portion of said hollow rigid substantially L-shaped frame;

b) stretching an upper portion of the sock over said U-shaped top, horizontally oriented, forwardly opening, elongated, and slender member of said substantially vertically-oriented portion of said hollow rigid substantially L-shaped frame;

c) pulling down the upper portion of the sock over said exterior of said substantially vertically-oriented portion of said hollow rigid substantially L-shaped frame and releasing so as to be compressingly secured thereto and ready for application;

d) gripping said pair of lower front, straight, substantially parallel-disposed, spaced-apart, substantially vertically-oriented, elongated, and slender members of said horizontally-oriented portion of said hollow rigid substantially L-shaped frame by the hands of a user with the forefingers being separated from the remaining fingers by said pair of lower intermediate side, straight, substantially parallel-disposed, skew-oriented, elongated and slender members of said horizontally-oriented portion of said hollow rigid substantially L-shaped frame, so that gripping ability is increased and unwanted rotation of the sock donning assist device is reduced during use;

e) inserting a toe portion of a foot of a leg into the lower portion of the sock;

f) pushing gently said sock donning assist device and the sock upwards on the leg with the upper portion of the sock pulling up and off said exterior of said substantially vertically-oriented portion of said hollow rigid substantially L-shaped frame and becoming compressingly secured to the leg; and g) removing said sock donning assist device with the leg leaving said U-shaped top, horizontally oriented, forwardly opening, elongated, and slender member of said substantially vertically-oriented portion of said hollow rigid substantially L-shaped frame.

* * * * *